United States Patent [19]

Ehlinger et al.

[11] 3,930,638

[45] Jan. 6, 1976

[54] HAND RAIL

[75] Inventors: Cleon L. Ehlinger, Peosta; Theodore D. Kipper, Dubuque, both of Iowa

[73] Assignee: Vanguard Countertops, Inc., Dubuque, Iowa

[22] Filed: Sept. 9, 1974

[21] Appl. No.: 504,272

[52] U.S. Cl. ..... 256/39
[51] Int. Cl.[2] ..... B21F 27/00
[58] Field of Search ..... 256/65

[56] References Cited

UNITED STATES PATENTS

| | | | |
|---|---|---|---|
| 1,954,242 | 4/1934 | Heppenstall | 312/263 X |
| 2,362,904 | 11/1944 | Kramer | 342/263 |
| 3,274,744 | 9/1966 | Blum et al. | 256/65 X |
| 3,748,009 | 7/1973 | Stone | 312/263 R |

FOREIGN PATENTS OR APPLICATIONS

| | | | |
|---|---|---|---|
| 957,244 | 0000 | France | 312/263 |

*Primary Examiner*—Robert L. Wolfe
*Assistant Examiner*—Doris L. Troutman
*Attorney, Agent, or Firm*—Zarley, McKee, Thomte & Voorhees

[57] ABSTRACT

A hand rail for use along hallways or stairways is disclosed which is particularly well suited for use in retirement homes, hospitals, etc. The hand rail comprises an elongated support means which is secured to the wall by a plurality of bolts extending therethrough and which has the rail element mounted thereon. The rail element comprises a flat vertically disposed outer member having an inwardly extending arcuate portion at its upper end. A support means is secured to the lower inside surface of the flat member and is adapted to be secured to the support means mounted on the wall. The two support means have mating beveled surfaces for properly positioning and supporting the rail element relative to the wall. The rail element is comprised of a particle board material having a high pressure plastic laminate secured thereto and extending around the exposed surfaces thereof. Each of the support means is also comprised of a particle board material which permits the entire assembly to be cheaply and easily manufactured.

7 Claims, 4 Drawing Figures

HAND RAIL

BACKGROUND OF THE INVENTION

This invention relates to a hand rail and more particularly to a hand rail which is comprised of a particle board material covered by a high pressure plastic laminate so that the cost of manufacturing the same is greatly reduced and so that the hand rail will not become damaged during use.

Hand rails along stairways and hallways in retirement homes or the like must be of a particular design so that if a person falls, there is no chance of his hand being caught between the wall and the rail. Conventional hand rails are made of solid wood and are very expensive to manufacture and are easily scarred and damaged.

Therefore, it is a principal object of the invention to provide an improved hand rail for hallways and stairways.

A further object of the invention is to provide a hand rail which may be economically produced.

A further object of the invention is to provide a hand rail comprised of a particle board material having a high pressure plastic laminate secured to the exposed surfaces thereof.

A further object of the invention is to provide a novel means for mounting a hand rail on a wall or the like.

A further object of the invention is to provide a hand rail which is durable in use and refined in appearance.

These and other objects will be apparent to those skilled in the art.

BRIEF DESCRIPTION OF THE DRAWINGS

This invention consists in the construction, arrangements and combination of the various parts of the device, whereby the objects contemplated are attained as hereinafter more fully set forth, specifically pointed out in the claims, and illustrated in the accompany drawings, in which:

DESCRIPTION OF THE PREFERRED EMBODIMENT

Figure 1:
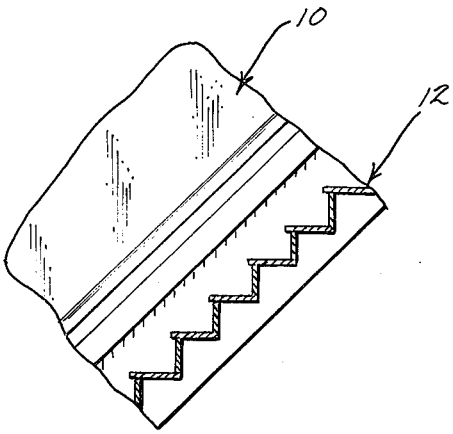
FIG. 1 is a side view illustrating the hand rail being employed on the wall adjacent a stairway.
Figure 2:
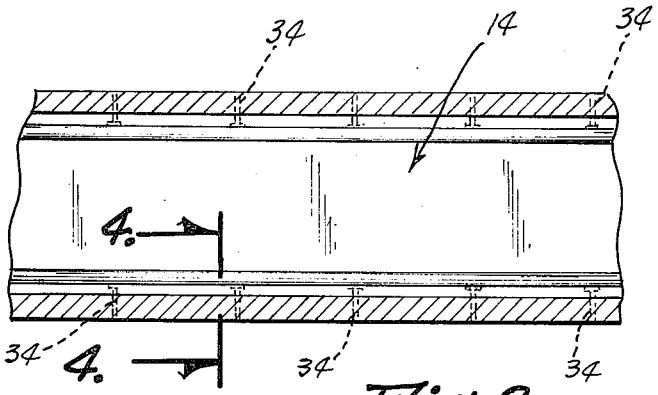
FIG. 2 is a top view of a hallway illustrating the hand rails of this invention being mounted on the walls thereof.

The numeral 10 in the drawings refers generally to a vertically disposed wall member which may be located adjacent the stairway 12 (FIG. 1) or the hallway 14 (FIG. 2). The hand rail of this invention is referred to generally by the reference numeral 16 and generally comprises a rail member 18 and a support means 20.

Figure 3:
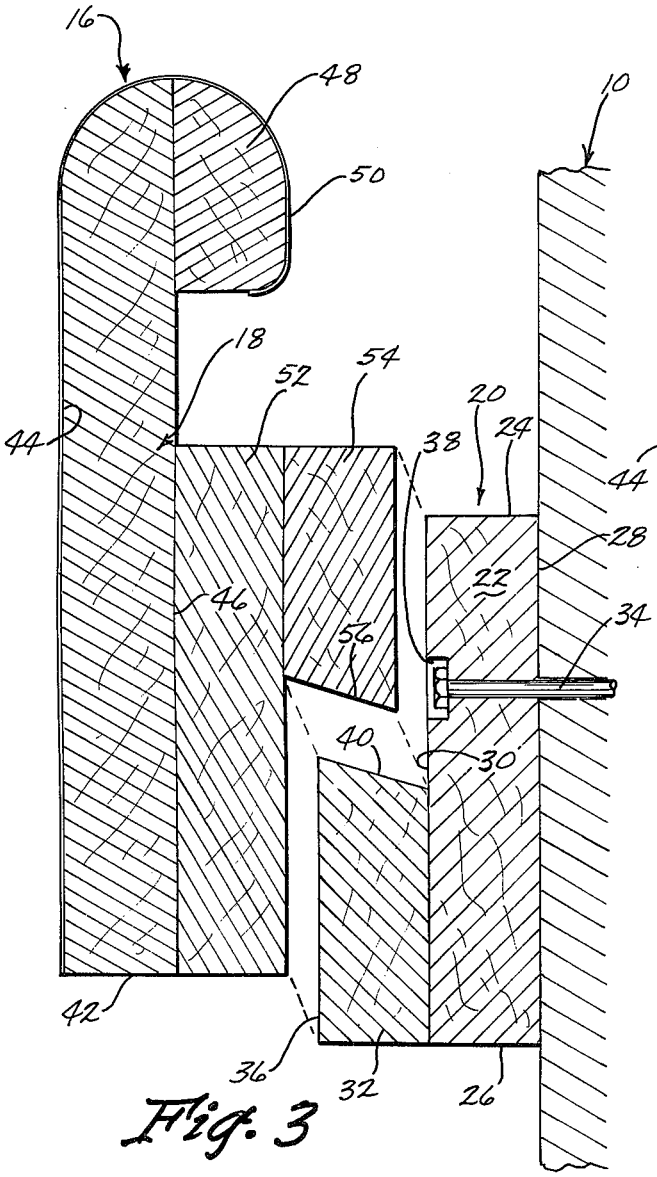
FIG. 3 is a sectional view as seen on lines 4 — 4 of FIG. 2 with the hand rail being removed from the supporting member.

Support means 20 comprises an elongated flat member 22 having an upper end 24, lower end 26, inner surface 28 and outer surface 30. The numeral 32 refers to an elongated flat member which is mounted adjacent the lower outside surface of the member 22 as illustrated in FIG. 3. Member 22 is maintained in the position seen in FIG. 3 by the bolt members 34 extending therethrough and through the wall 10. Member 32 is secured to the member 22 by adhesive or the like. As seen in FIG. 3, the outer surface 30 of member 22 is provided with a recess 38 adapted to receive the head portion of the bolt 34. Member 32 is provided with a beveled upper end 40 which extends downwardly and inwardly towards the member 22 as illustrated in FIG. 3.

Rail member 18 comprises a lower end 42, outer surface 44, inner surface 46 and an arcuate upper end portion 48 which extends inwardly therefrom. The numeral 50 refers to a high pressure laminate which is secured to the exposed surfaces of the rail member 18 by a contact bond adhesive such as sold by Roberts Consolidated Company under the trademark ANCHOR-WELD. The high pressure plastic laminate 500 is preferably selected from the group consisting of MICARTA, FORMICA, and TEXTOLITE. MICARTA is a product manufactured by Westinghouse Corporation while FORMICA and TEXTOLITE are trademarked products of American Cyanamide and General Electric respectively. Preferably, the thickness of the high pressure plastic laminate 50 is 1/32 inch. Although the high pressure laminates referred to above are the preferred embodiment, low pressure laminates and vinyl coverings may be substituted therefore with reduced durability characteristics being present in the finished product.

Figure 4:
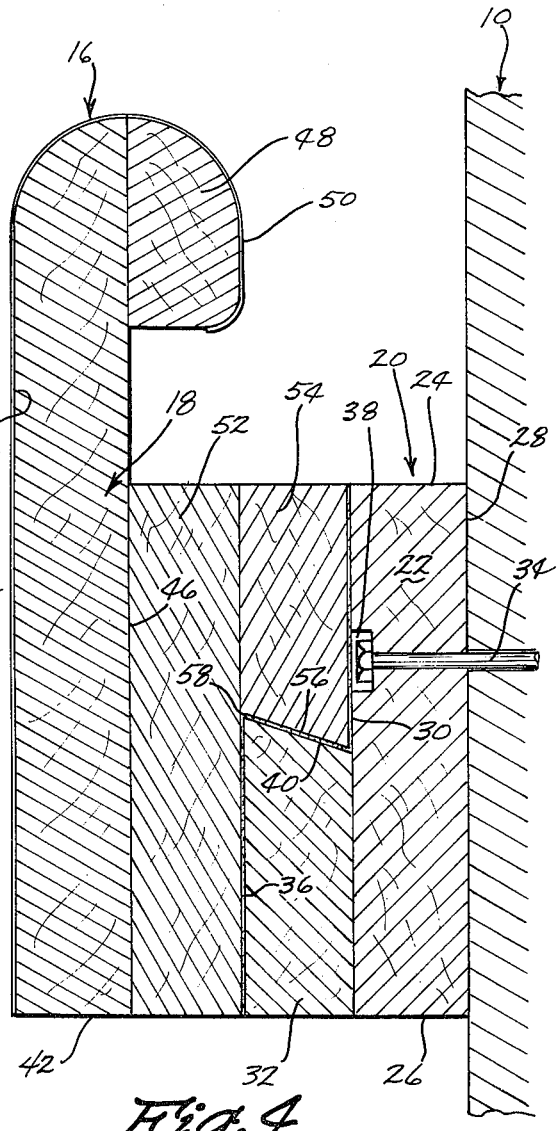
FIG. 4 is a sectional view seen on lines 4 — 4 of FIG. 2.

An elongated flat member 52 is secured to the lower inside surface of the rail member 18 by any suitable contact bond adhesive such as ANCHOR-WELD in the manner illustrated in FIGS. 3 and 4. The numeral 54 refers to an elongated flat member which is secured to the upper inside surface of the member 52 by adhesive or the like. Member 54 is provided with a beveled lower end 56 which is adapted to mate with the beveled upper end 40 of member 32.

The method of installation is as follows. The members 22 and 32 are secured to the wall 10 by the bolts 34 extending through the member 22 as previously described. Member 32 will have been previously secured to member 22. The members 52 and 54 will have previously been secured to the rail member 18 so that the assembly may be secured together asd illustrated in FIG. 3. In FIG. 4, the numeral 58 refers to a layer of adhesive or the like which is positioned between the members 32, 54 and 52 and 22 so that the assembly is rigidly secured together. As seen in FIG. 4, the members 52, 54 and 22 have their upper ends dwelling in a common plane so that a person's hand cannot become lodged or caught between the rail and the wall if the person should accidently fall or slip. The members 18, 48, 52, 32 and 22 are comprised of a particle board material which permits the hand rail to be economically produced. The high pressure laminate 50 provides an extremely durable outer covering for the hand rail which prevents scarring or damaging of the hand rail. The hand rail is rigidly mounted on the wall through the bolts and the mating beveled edges as well as the contact cement provided therebetween as previously described.

Thus it can be seen that the hand rail accomplishes at least all of its stated objectives.

We claim:

1. A hand rail for attachment to a vertically disposed planar support wall, said hand rail comprising:

an elongated support means adapted to be secured to the support wall and having a top portion, a bottom portion and an outer end portion spaced from the support member, an elongated rail member secured to the outer end portion of said support means and having an inwardly extending upper end portion spaced above the upper end of said support means, said support means comprising first and second elongated flat members joined together and having upper surfaces which combine to form an elongated upwardly presented surface extending along substantially the entire length of said rail member to prevent a person's hand from being caught between said support wall and said rail member;

securing means for operatively securing said first member to said support wall;

said first member having in cross section two vertical surfaces interconnected by an upwardly presented beveled surface extending downwardly and towards said support wall;

said second member carrying said rail member and having in cross section two vertical surfaces interconnected by a downwardly presented beveled surface extending upwardly and away from said support wall, said vertical and beveled surfaces of said first and second members being matingly joined whereby said mating beveled surfaces support said second member on said first member and urge said second member towards said support wall;

all of said vertical and beveled surfaces extending along the length of said rail so as to provide continuous support thereof and so as to close the space between said rail and said support wall; and an adhesive joining said mated surfaces of said first and second members.

2. A rail according to claim 1 wherein said rail member is comprised of a particle board material and a laminate material is secured to said particle board material of said rail member.

3. The hand rail of claim 1 wherein said laminate material is a plastic laminate material.

4. The hand rail of claim 3 wherein said plastic laminate material is a high pressure plastic laminate.

5. The hand rail of claim 4 wherein said plastic laminate material is selected from a group consisting of MICARTA, FORMICA and TEXTOLITE.

6. The hand rail of claim 3 wherein said rail member is comprised of layers of particle board material secured together in a laminated manner.

7. The hand rail of claim 6 wherein said support means is comprised of layers of particle board material secured together in a laminated manner.

* * * * *